United States Patent [19]

Nagai et al.

[11] Patent Number: 4,712,373

[45] Date of Patent: Dec. 15, 1987

[54] DOUBLE AIR-FUEL RATIO SENSOR SYSTEM HAVING IMPROVED RESPONSE CHARACTERISTICS

[75] Inventors: Toshinari Nagai, Susono; Takatoshi Masui; Yasushi Satou, both of Mishima; Toshiyasu Katsuno, Susono, all of Japan

[73] Assignee: Toyota Jidosha Kabushiki Kaisha, Aichi, Japan

[21] Appl. No.: 849,839

[22] Filed: Apr. 9, 1986

[30] Foreign Application Priority Data

Apr. 12, 1985 [JP] Japan ..... 60-076615

[51] Int. Cl.[4] ..... F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,497,296 | 2/1985 | Nakajima et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72646 | 4/1983 | Japan . |
| 58-72647 | 4/1983 | Japan . |
| 58-135343 | 8/1983 | Japan . |
| 58-152147 | 9/1983 | Japan . |
| 58-150038 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, the actual air-fuel ratio is adjusted in accordance with the output of the upstream-side and downstream-side air-fuel ratio sensors. For a predetermined time period after the engine enters an air-fuel ratio feedback control for the downstream-side air-fuel ratio sensor, the control speed by the downstream-side air-fuel ratio sensor is increased.

16 Claims, 53 Drawing Figures

LEAN
RICH
A/F
TDR1
CDLY1

0
t1
t2
t3
t4
t5
t6
t7
t8
TDL1

TDR1
(-TDL1)
F1
LEAN
RICH
TDR1

RSL1
KIR1
FAF1
RSR1
KIL1

| Fig. 5 A | Fig. 5 B | Fig. 5 C | Fig. 5 D |
|---|---|---|---|

V
1
0
V1
VR1
RICH
LEAN
TDR1
TDL1
F1
KIR1
RSL1
FAF1
RSR1
KIL1
V2
VR2
TDL2
TDR2
F2
KI2
RS2
FAF2

OPEN-LOOP CONTROL
CLOSED-LOOP CONTROL

V2
VR2

LEAN
RICH
TDR2
(-TDL2)
F2

LEAN
RICH

α
C
t0
t1
t2

KI2
KI2
FAF2
3×KI2
RS2
KI2
FAF2'
FAF2 = 1.0

V
1
0
V1
VR1
RICH
LEAN
TDR1
TDL1
F1
KIR1
RSL1
FAF1
RSR1
KIL1
V2
VR2
TDL2
TDR2
F2
TR1
TR2
TL1
TL2

OPEN-LOOP CONTROL
CLOSED-LOOP CONTROL

V2
VR2

RICH
LEAN
(-TDL2)
TDR2

RICH
LEAN

α
C
t0
t1
t2
TR1
TDR1=12
TDR1'
TDR1
TR2

0
TL1
TDL1=-6
TDL1'
TDL1
TL2

A/F1
LEAN
RICH
TDL1
CDLY1
t1
t2
t3
t4
t5
t6
t7
t8
0
TDR1
F1
(-TDR1)
TDL1
(-TDR1)
LEAN
RICH
KIR1
FAF1
KIL1
RSL1
RSR1

DOUBLE AIR-FUEL RATIO SENSOR SYSTEM HAVING IMPROVED RESPONSE CHARACTERISTICS

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Drescription of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems, have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, during a non air-suel ratio feedback control, i.e., an open control for the downstream-side $O_2$ sensor, the controlled air-fuel ratio may be greatly deviated from an optimum level such as the stoichiometric air-fuel ratio. In this case, when the engine is switched from an open control to an air-fuel ratio feedback control (closed-loop control) for the downstream-side $O_2$ sensor, a long period of time must elapse before the controlled air-fuel ratio reaches the optinum level, thereby causing an overrich or overlean condition in the controlled air-fuel ratio, and thus deteriorating the fuel consumption, the drivability, and the condition of the exhaust emissions such as HC, CO, and $NO_X$.

Note that, in order to compensate for the overrich or overlean air-fuel ratio immediately after the switching from an open control to a closed-loop control, a learning control has been suggested. For example, parameters calculated during an air-fuel feedback control are always stored as learning parameters in a backup random access memory (RAM), and therefore, when the engine returns to a closed-loop control, such a closed-loop control is started by using the learning parameters stored in the backup RAM, thus immediately obtaining an optimum air-fuel ratio level even when the controlled air-fuel ratio is deviated from the optimum level. Note that present invention is applied to a double $O_2$ sensor system which does not carry out a learning control.

SUMMARY OF THE INVENTION

It is an object of the present invention to provide a double air-fuel ratio sensor system in an internal combustion engine with which the fuel consumption, the drivability, and the exhaust emission characteristics are improved even when the controlled air-fuel ratio during an open control is greatly deviated from the optinum level.

According to the present invention, in a double air-fuel ratio sensor system including two $O_2$ sensors upstream and downstream of a catalyst converter provided in an exhaust passage, the actual air-fuel ratio is adjusted by using the output of the upstream-side $O_2$ sensor and the output of the downstream-side $O_2$ sensor. In this system, for a predetermined period of time after the engine enters a closed-loop control for the downstream-side $O_2$ sensor, the control speed by the downstream-side $O_2$ sensor is increased. As a result, even when the controlled air-fuel ratio is greatly deviated from the optimum level during an open control, the controlled air-fuel ratio promptly reaches the optimum level after the engine has entered a closed-loop control for the downstream-side $O_2$ sensor.

BRIEF DESCRIPTION OF THE DRAWINGS

The present invention will be more clearly understood from the description as set forth below with reference to the accompanying drawings, wherein;

FIGS. 3, 3A–3C, 5, 5A–5D, 6, 9, 9A–9C, 10, 13, and 15 are flow charts showing the operation of the control circuit of FIG. 2;

DESCRIPTION OF THE PREFERRED EMBODIMENTS

Figure 1:
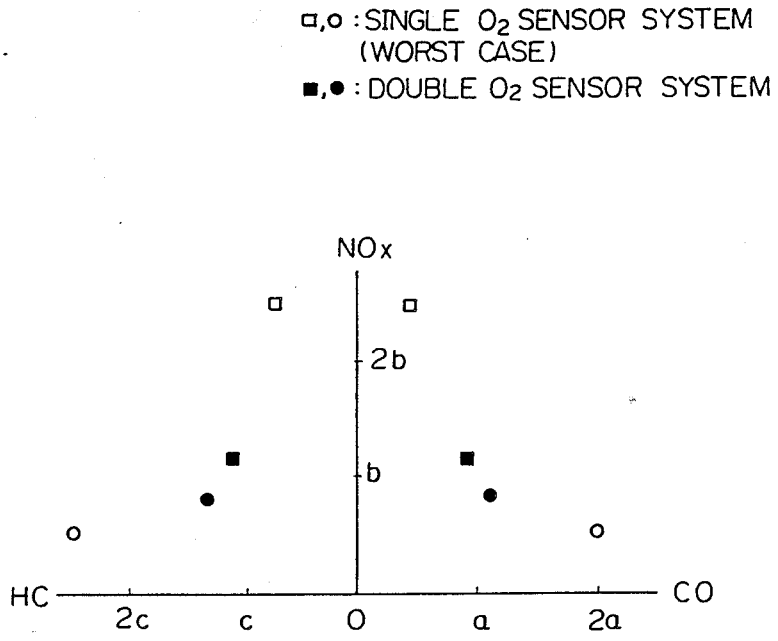
FIG. 1 is a graph showing the emission characteristics of a single $O_2$ sensor system (worst case) and a double $O_2$ sensor system.
Figure 2:
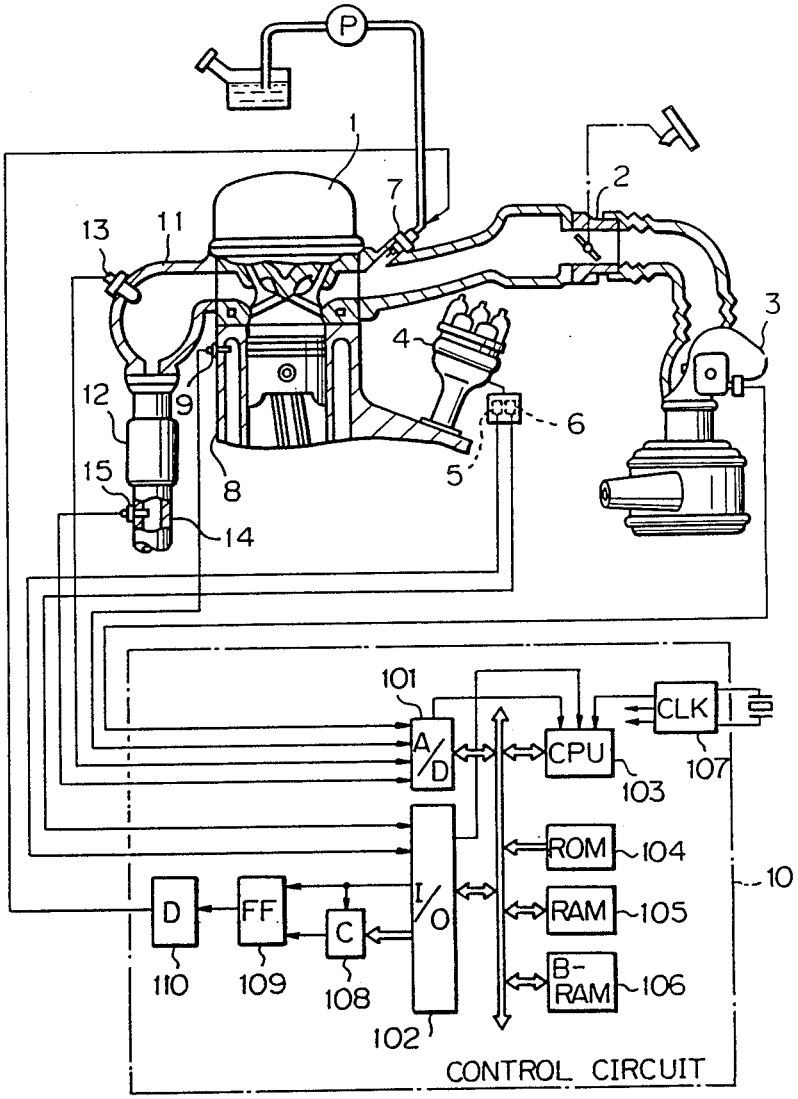
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed ina distributor 4 are crank angle sensors 5 and 6 for detecting the angle of the crankshaft (not shown) of the engine 1. In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a centeral processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal; and when the clock generator 109 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 2 of FIG. 2 will be now explained.

Figure 3A:
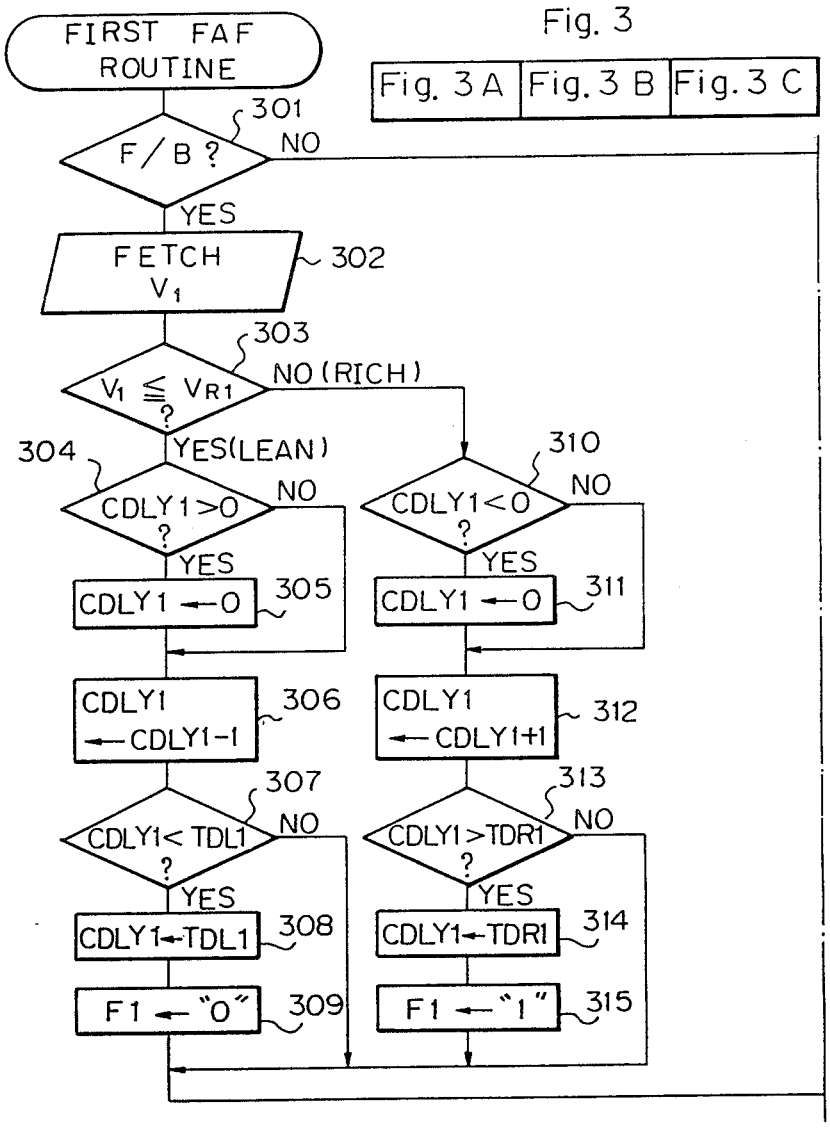
Figure 3B:
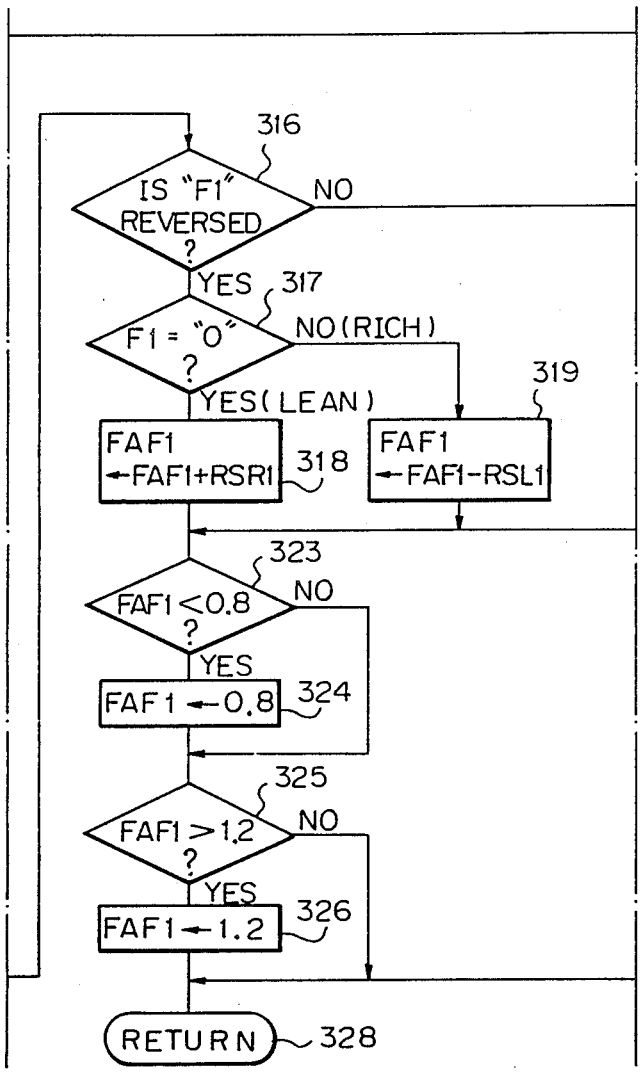
Figure 3C:
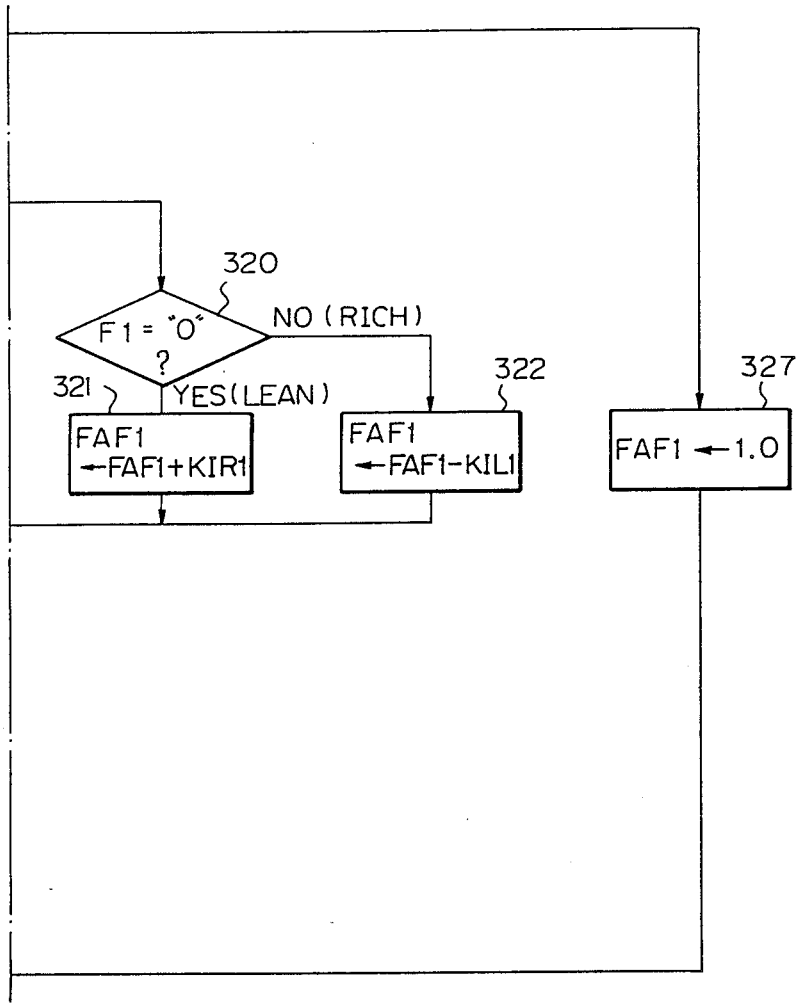

FIG. 3 is a routine for calculating a first air-fuel ratio feedback correction amount FAF1 in accordance with the output of the upstream-side $O_2$ sensor 13 executed at every predetermined time period such as 4 ms.

At step 301, it is determined whether or not all the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the poer fuel incrementantal amount FPOWER is 0; and (iv) the upstream-side $O_2$ sensor 13 is not in an activated state.

Note that the determination of activation/nonactivation of the upstream-side $O_2$ sensor 13 is carried out by determining whether or not the coolant temperature THW≧70° C., or by whether or not the output of the upstream-side $O_2$ sensor 13 is once swung from the lean side to the rich side, or vice versa. Of course, other feedback control conditions are introduced as occasion demands. However, an explanaiton of such other feedback control conditions is omitted.

If one or more of the feedback control conditions is not satisfied, the control proceeds to step 327, in which the correction amount FAF is caused to be 1.0 (FAF1=1.0), thereby carrying out an open-loop control operation. Note that, in this case, the correction amount FAF1 can be a learning value or a value immediately before the feedback control by the upstream-side $O_2$ sensor 13 is stopped.

Contrary to the above, at step 301, if all of the feedback control conditions are satisfied, the control proceeds to step 302.

At step 302, an A/D conversion is performed upon the output voltage $V_1$ of the upstream-side $O_2$ sensor 13, and the A/D converted value thereof is then fetched from the A/D converter 101. Then, at step 303, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 304, which determines whether or not the value of a first delay counter CDLY1 is positive. If CDLY1>0, the control proceeds to step 305, which clears the first delay counter CDLY1, and then proceeds to step 306. If CDLY1≦0, the control proceeds directly to step 306. At step 306, the first delay counter CDLY1 is counted down by 1, and at step 307, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 307, only when CDLY1<TDL1 does the control proceed to step 308, which causes CDLY1 to be TDL1, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the first delay counter CDLY1 is negative. If CDLY1<0, the control proceeds to step 311, which clears the first delay counter CDLY1, and then proceeds to step 312. If CDLY1≧0, the control directly proceeds to 312. At step 312, the first delay counter CDLY1 is counted up by 1, and at step 313, it is determined whether or not CDLYl>TDR1. Note that TDR1 is a rich delay time period for which a lean state is maintained even after the output of the upstream-side $O_2$ sensor 13 is changed from the lean side to the rich side, and is defined by a positive value. Therefore, at step 313, only when CDLY1>TDR1 does the control proceed to step 314, which causes CDLY1 to be TRR1, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 317 to 319, which carry out a skip operation. That is, if the flag F1 is "0" (lean) at step 317, the control proceeds to step 318, which remarkably increases the correction amount FAF1 by a skip amount RSR1. Also, if the flag F1 is "1" (rich) at step 317, the control procees to step 319, which remarkably decreases the correction amount FAF1 by the skip amount RSL1. On the other hand, if the first air-fuel ratio flag F1 is not reversed at step 316, the control proceeds to steps 320 to 322, which carries out an intergration operation. That is, if the flag F1 is "0" (lean) at step 320, the control proceeds to step 321, which gradually increases the correction amount FAF1 by a rich integration amount KIR1. Also, if the flag F1 is "1" (rich) at step 320, the control proceeds to step 322, which gradually decreases the correction amount FAF1 by a lean integration amount KIL1.

Note that the skip amount RSR1 (RSL1) is larger than the integration amount KIR1 (KIL1).

The correction amount FAF1 is guarded by a minimum value 0.8 at steps 323 and 324, and by a maximum value 1.2 at steps 325 and 326, thereby also preventing the controlled air-fuel ratio from becoming overrich or overlean.

The correction amount FAF1 is then stored in the RAM 105, thus completing this routine of FIG. 3 at step 328.

Figures 4A, 4B, 4C, 4D:
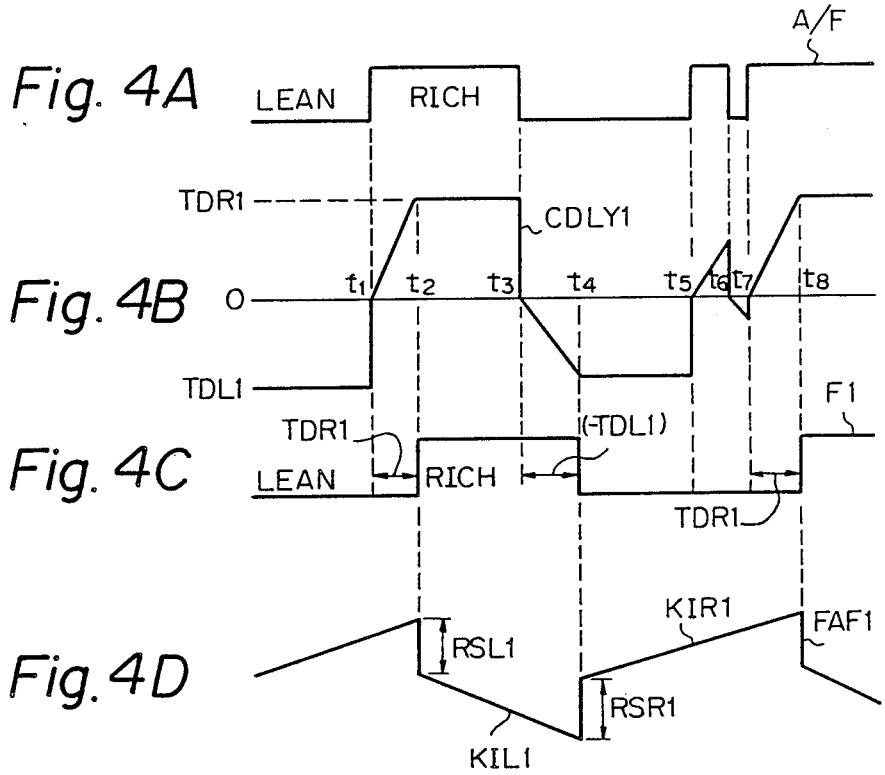
FIG. 4A through 4D are timing diagrams explaining the flow charts of FIG. 3.

The operation by the flow chart of FIG. 3 will be further explained with reference to FIGS. 4A through 4D. As illustrated in FIG. 4A, when the air-fuel ratio A/F is obtained by the output of the upstream-side $O_2$ sensor 13, the first delay counter CDLY1 is counted up during a rich state, and is counted down during a lean state, as illustrated in FIG. 4B. As a result, a delayed air-fuel ratio corresponding to the first air-fuel ratio flag F1 is obtained as illustrated in FIG. 4C. For example, at time $t_1$, even when the air-fuel ratio A/F is changed from the lean side to the rich side, the delayed air-fuel ratio F1 is changed at time $t_2$ after the rich delay time period TDR1. Similarly, at time $t_3$, even when the air-fuel ratio A/F is changed from the rich side to the lean side, the delayed air-fuel ratio F1 is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio F1 is reversed at time $t_8$. That is, the delayed air-fuel ratio F1 is stable when compared with the air-fuel ratio A/F. Further, as illustrated in FIG. 4D, at every change of the delayed air-fuel ratio F1 from the rich side to the lean side, or vice versa, the correction amount FAF1 is skipped by the skip amount RSR1 or RSL1, and also, the correction amount FAF1 is gradually increased or decreased in accordance with the delayed air-fuel ratio F1.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR1 and the lean skip amount RSL1), and an integration amount KI (in more detail, the rich integration amount KIR1 and the lean integration amount KIL1).

For example, if the rich delay time period becomes larger than the lean delay time period (TDR1>TDL1), the controlled air-fuel ratio becomes richer, and if the lean delay time period becomes larger than the rich delay time period (TDL1>TDR1), the controlled air-fuel ratio becomes leaner. Thus the air-fuel ratio can be controlled by changing the rich delay time period TDR1 and the lean delay time period TDL1 in accordance with the output of the downstream-side $O_2$ sensor 15. Also, if the rich skip amount RSR1 is increased or if the lean skip amount RSL1 is decreased, the controlled air-fuel ratio becomes richer, and if the lean skip amount RSL is increased or if the rich skip amount RSR1 is decreased, the controlled air-fuel ratio becomes leaner. Thus, the air-fuel ratio can be controlled by changing the rich skip amount RSR 1 and the lean skip amount RSL1 in accordance with the output of the downstream-side $O_2$ sensor 15. Further, if the rich integration amount KIR1 is increased or if the lean integration amount KIL1 is decreased, the controlled air-fuel ratio becomes richer, and if the lean integration amount KIL1 is increased or if the rich integration amount KIR1 is decreased, the controlled air-fuel ratio becomes leaner. Thus, the air-fuel ratio can be controled by changing the rich integration amount KIR1 and the lean integration amount KIL1 in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sentos system into which a second air-fuel ratio correction amount FAF2 is introduced will be explained with reference to FIGS. 5 and 6.

Figures 5, 5A:
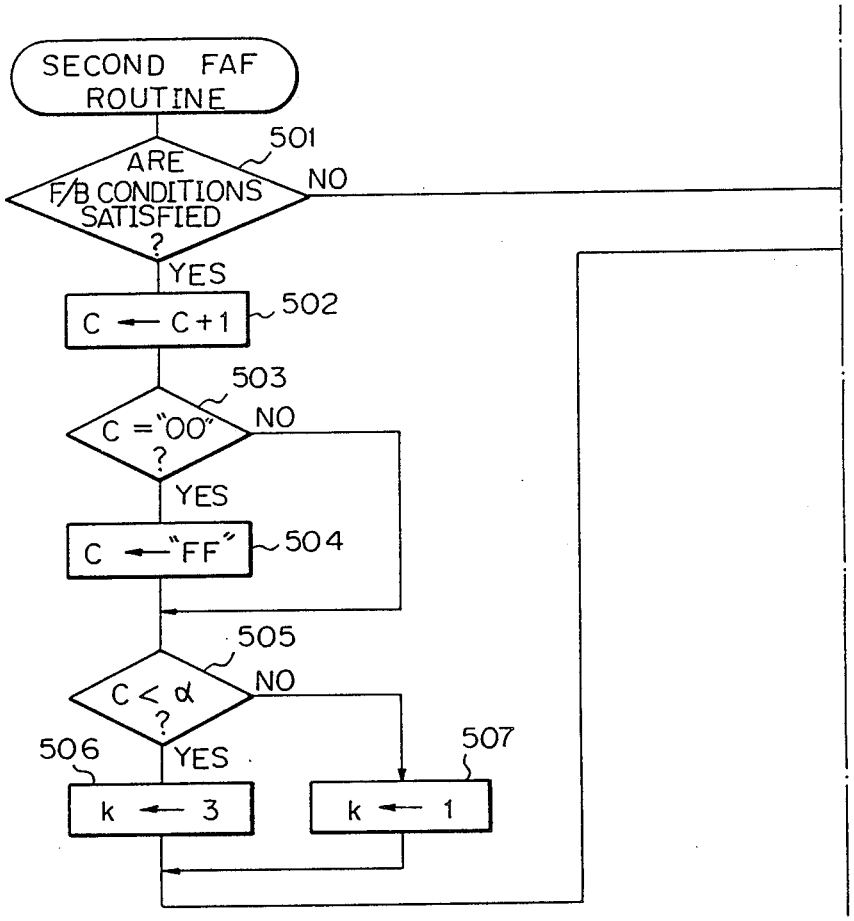
Figure 5B:
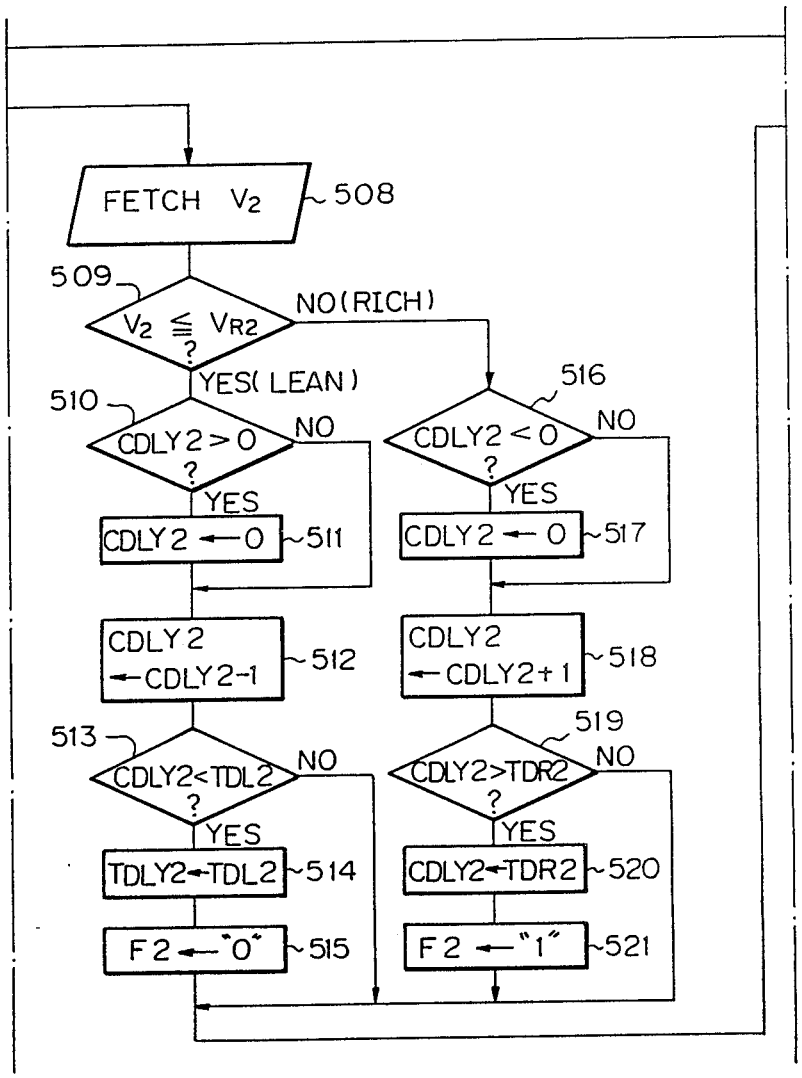
Figure 5C:
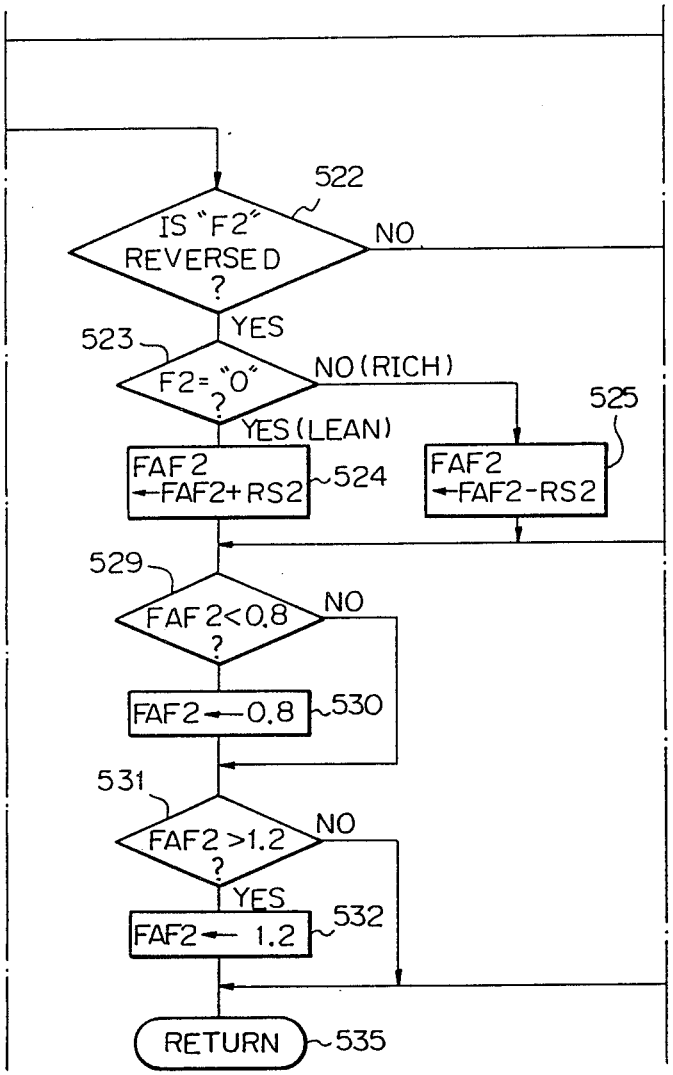
Figure 5D:
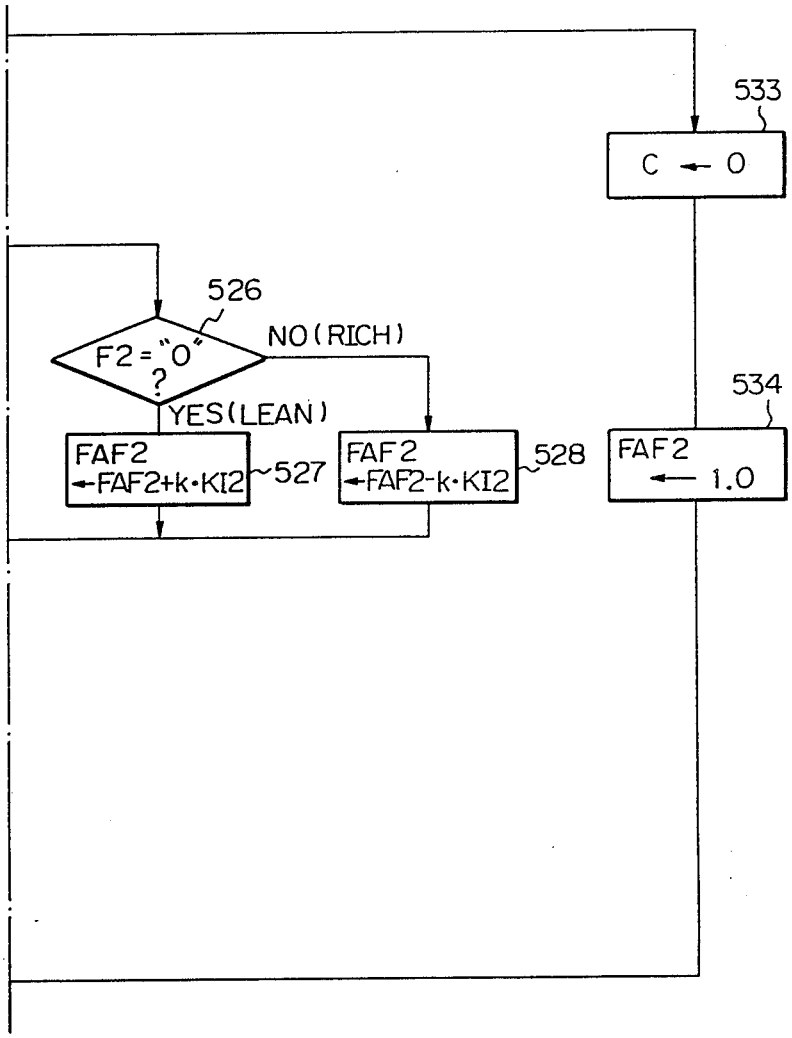

FIG. 5 is a routine for calculating a second air-fuel ratio feedback correction amount FAF2 in accordance with the output of the downstream-side $O_2$ sensor 15 executed at every predetermined time period such as 1 s.

At step 501, it is determined whether or not all the feedback control (closed-loop control) conditions by the downstream-side $O_2$ sensor 15 are satisfied. The feedback control conditions are as follows:

(i) the engine is not in a starting state;

(ii) the coolant temperature THW is higher than 50° C.;

(iii) the power fuel incrementantal amount FPOWER is 0; and (iv) the downstream-side $O_2$ sensor 15 is not in an activated state. Note that the determination of activation/nonactivation of the downstream-side $O_2$ sensor 15 is carried out by determining whether or not the coolant temperature THW≧70° C., or by whether or not the output of the downstream-side $O_2$ sensor 15 is once swung from the lean side to the rich side, or vice versa. Of course, other feedback control conditions are introduced as occasion demands. However, an explanation of such other feedback control conditions is omitted.

If one or more of the feedback control conditions is not satisfied, the control proceeds to step 533, which clears a counter C, and then, at step 534, the correction amount FAF2 is caused to be 1.0 (FAF2=1.0), thereby carrying out an open-loop control operation. Note that, also in this case, the correction amount FAF2 can be a learning value or a value immediately before the feedback control by the downstream-side $O_2$ sensor 15 is stopped.

Contrary to the above, at step 501, if all of the feedback control conditions are satisfied, the control proceeds to step 502. That is, when the engine is switched from an open-loop control to a closed-loop control, the flow at step 501 proceeds to step 502, which advances the counter C. At steps 503 and 504, the counter C is guarded by a maxinum value such as "FF" (hexadecimal notation), and then the control proceeds to step 505, which determines whether or not the counter C exceeds a predetermined value $\alpha$. If $C>\alpha$, the countrol proceeds to step 506, which causes a parameter k to be 3, while if $C\leqq\alpha$, the control proceeds to step 507, which causes the parameter k to be 1. Note that the parameter k determines the feedback control speed by the downstream-side $O_2$ sensor 15. In this case, the parameter k serves as a correction cofficient of correcting an integration amount KL2. Therefore, the integration speed (time constant) where $C<\alpha$ is three times that where $C\geqq\alpha$. However, the parameter k can be also a value other than 3 ($k>1$).

At step 508, an A/D conversion is performed upon the output voltage V2 of the downstream-side $O_2$ sensor 15, and the A/D converted value thereof is then fetched from the A/D converter 101. Then, at step 509, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$(=0.55 V) is preferably higher than the reference voltage $V_{R1}$(=0.45 V), in consideration of the difference in output characteristics and deterioration speed between the $O_2$ sensor 13 upstream of the catalyst converter 12 and the $O_2$ sensor 15 downstream of the catalyst converter 12.

Steps 510 through 521 correspond to step 304 through 315, respectively, thereby performing a delay operation upon the determination at step 509. Here, a rich delay time period is defined by TDR2, and a lean delay time period is defined by TDL2. As a result of the delayed determination, if the air-fuel ratio is rich a second air-fuel ratio flag F2 is caused to be "1", and if the air-fuel ratio is lean, a second air-fuel ratio flag F2 is caused to be "0".

Next, at step 522, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 523 to 525 which carry out a skip operation. That is, if the flag F2 is "0" (lean) at step 523, the control proceeds to step 524, which remarkably increases the second correction amount FAF2 by skip amount RS2. Also, if the flag F2 is "1" (rich) at step 523, the control proceeds to step 525, which remarkably decreases the second correction amount FAF2 by the skip amount RS2. On the other hand, if the second air-fuel ratio flag F2 is not reversed at step 522, the control proceeds to steps 526 to 528, which carries out an integration operation. That is, if the flag F2 is "0" (lean) at step 526, the control proceeds to step 527, which gradually increases the second correction amount FAF2 by an integration amount k·KI2. Also, if the flag F2 is "1" (rich) at step 526, the control proceeds to step 528, which gradually decreases the second correction amount FAF2 by the integration amount k·KI2.

Note that the skip amount RS2 is larger than the integration amount KI2.

The second correction amount FAF2 is guarded by a minimum value 0.8 at steps 529 and 530, and by a maximum value 1.2 at step 531 and 532, thereby also preventing the controlled air-fuel ratio from becoming overrich or overlean.

The correction amount FAF2 is then stored in the RAM 105, thus completing this routine of FIG. 5 at step 535.

Thus, for a predetermined time period ($C<\alpha$) after the engine enters an air-fuel feedback control for the downstream-side $O_2$ sensor 15, the integration amount is increased, and therefore, the controlled air-fuel ratio promptly reaches an optimum level even when the controlled air-fuel ratio is greatly deviated from this optimum level during an open-loop control.

Figure 6:
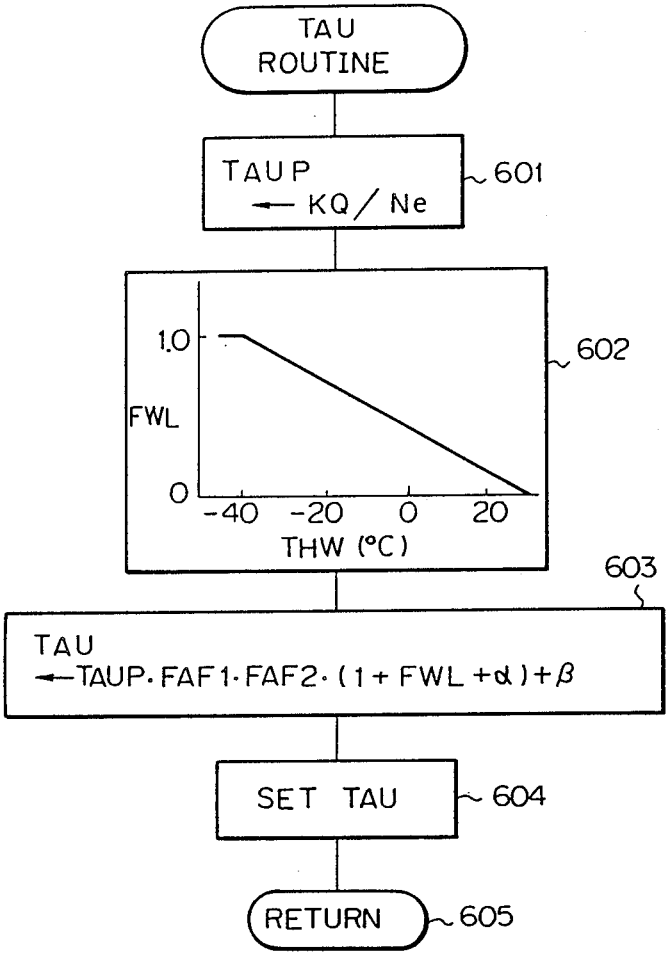

FIG. 6 is a routine for calculating a fuel injection amount TAU executed at every predetermined crank angle such as 360° CA. At step 601, a base fuel injection amount TAUP is calculated by using the intake air amount data Q and the engine speed data Ne stored in the RAM 105. That is, $$TAUP \leftarrow KQ/Ne$$

where K is a constant. Then at step 602, a warming-up incremental amount FWL is calculated from a one-dimensional map by using the coolant temperature data THW stored in the RAM 105. Note that the warming-up incremental amount FWL decreases when the coolant temperature THW increases. At step 603, a final fuel injection amount TAU is calculated by $$TAU \leftarrow TAUP \cdot FAF1 \cdot FAF2(1+FWL+\alpha)+\beta$$

where $\alpha$ and $\beta$ are correction factors determined by other parameters such as the voltage of the battery and the temperature of the intake air. At step 604, the final fuel injection amount TAU is set in the down counter 108, and in addition, the flip-flop 109 is set to initiate the activation of the fuel injection valve 7. Then, this routine is completed by step 605. Note that, as explained above, when a time period corresponding to the amount TAU passes, the flip-flop 109 is reset by the carry-out signal of the down counter 108 to stop the activation of the fuel injection valve 7.

Figures 7A, 7B, 7C, 7D, 7E, 7F, 7G, 7H:
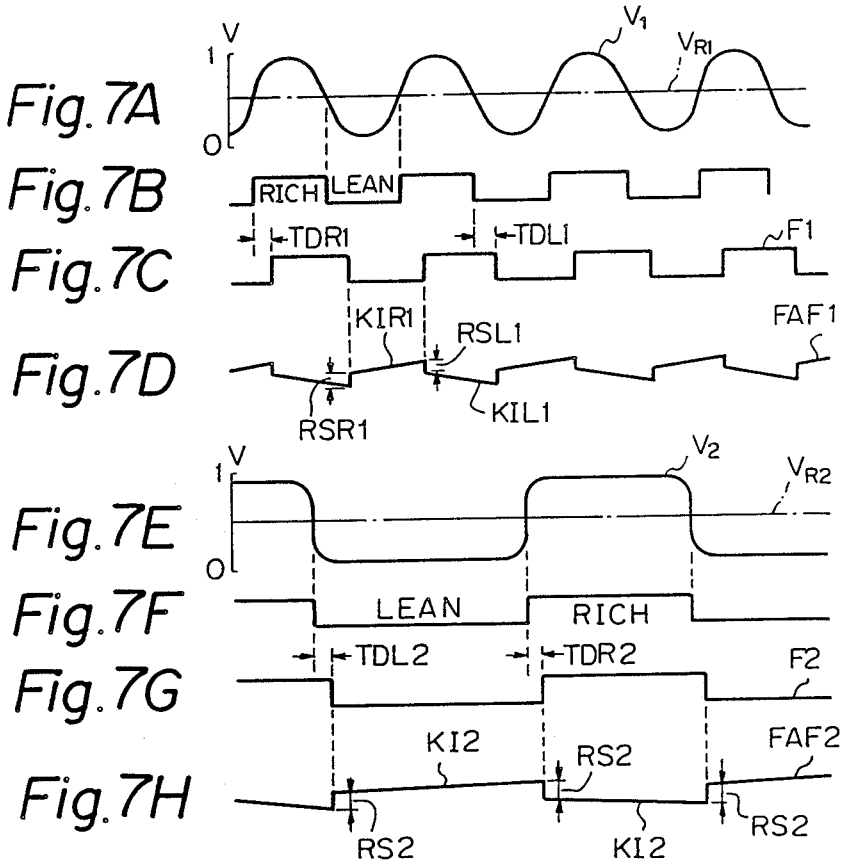
FIGS. 7A through 7H and FIGS. 8A through 8D are timing diagrams explaining the flow chart of FIGS. 3, 5, and 6.

FIGS. 7A through 7H are timing diagrams for explaining the two air-fuel ratio correction amounts FAF1 and FAF2 obtained by the flow charts of FIGS. 3, 5, and 6. In this case, the engine is in a closed-loop control state for the two $O_2$ sensors 13 and 15. When the output of the upstream-side $O_2$ sensor 13 is changed as illustrated in FIG. 7A, the determination at step 303 of FIG. 3 is shown in FIG. 7B, and a delayed determination thereof corresponding to the first air-fuel ratio flag F1 is shown in FIG. 7C. As a result, as shown in FIG. 7D, every time the delayed determination is changed from the rich side to the lean side, or vice versa, the first air-fuel ratio correction amount FAF1 is skipped by the skip amount RSR1 or RSL1. On the other hand, when the output of the downstream-side $O_2$ sensor 15 is changed as illustrated in FIG. 7E, the determination at step 503 of FIG. 5 is shown in FIG. 7F, and the delayed determination thereof corresponding to the second air-fuel ratio flag F2 is shown in FIG. 7G. As a result, as shown in FIG. 7H, every time the delayed determination is changed from the rich side to the lean side, or vice versa, the second air-fuel ratio correction amount FAF2 is skipped by the skip amount RS2.

Figures 8A, 8B, 8C, 8D, 8E:
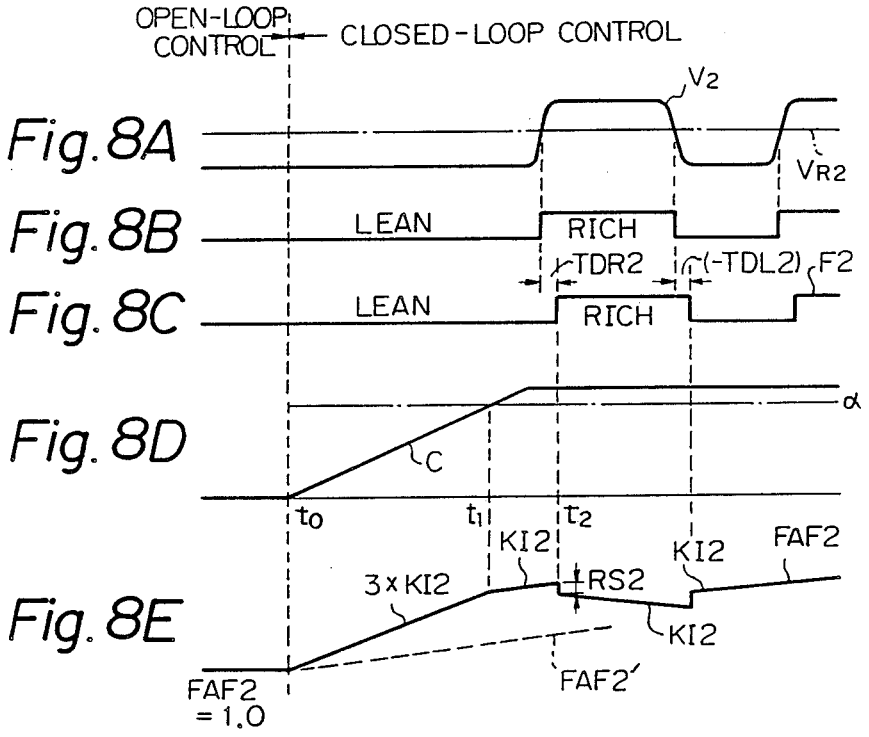

In a second air-fuel ratio control by the downstream-side $O_2$ sensor 15, a transition from an open-loop control to a closed-loop control will be explained in more detail with reference to FIGS. 8A through 8E. For example, before time $t_0$, the output of the downstream-side $O_2$ sensor 15 remains on the lean side, as shown in FIG. 8A. In this case the counter C remains at zero, as shown in FIG. 8D, and the second air-fuel ratio correction amount FAF2 is caused at 1.0 as shown in FIG. 8E. At time $t_0$, the engine enters a closed-loop control and the counter C is advanced. As a result, for a time period of from time $t_0$ to time $t_1$ at which the counter C reaches $\alpha$, the second air-fuel ratio correction amount FAF2 is increased at the integration speed of 3KI2, and subsequently, the second air-fuel ratio correction amount FAF2 is increased at the integration speed of KI2. As a result, the second air-fuel ratio correction amount FAF2 promptly reaches a desired level, and accordingly, the controlled air-fuel ratio reaches the optimum level such as the stoichiometric air-fuel ratio. Note that FIG. 8B illustrates the determination at step 509 of FIG. 5 and FIG. 8C illustrates the second air-fuel ratio flag F2.

If the second air-fuel ratio correction amount FAF2 is increased at the integration speed of KI2 even after time $t_0$, the second air-fuel ratio correction amount FAF2 is changed as indicated by a dotted line in FIG. 8E, and therefore, a long period of time must elapse before the second air-fuel correction amount FAF2 reaches the desired level.

A double $O_2$ sensor system, in which an air-fuel ratio feedback control constant of the first air-fuel ratio feedback control by the upstream-side $O_2$ sensor is variable, will be explained with reference to FIGS. 9 and 10. In this case, the delay time periods TDR1 and TDL1 as the air-fuel ratio feedback control parameters are variable.

Figure 9A:
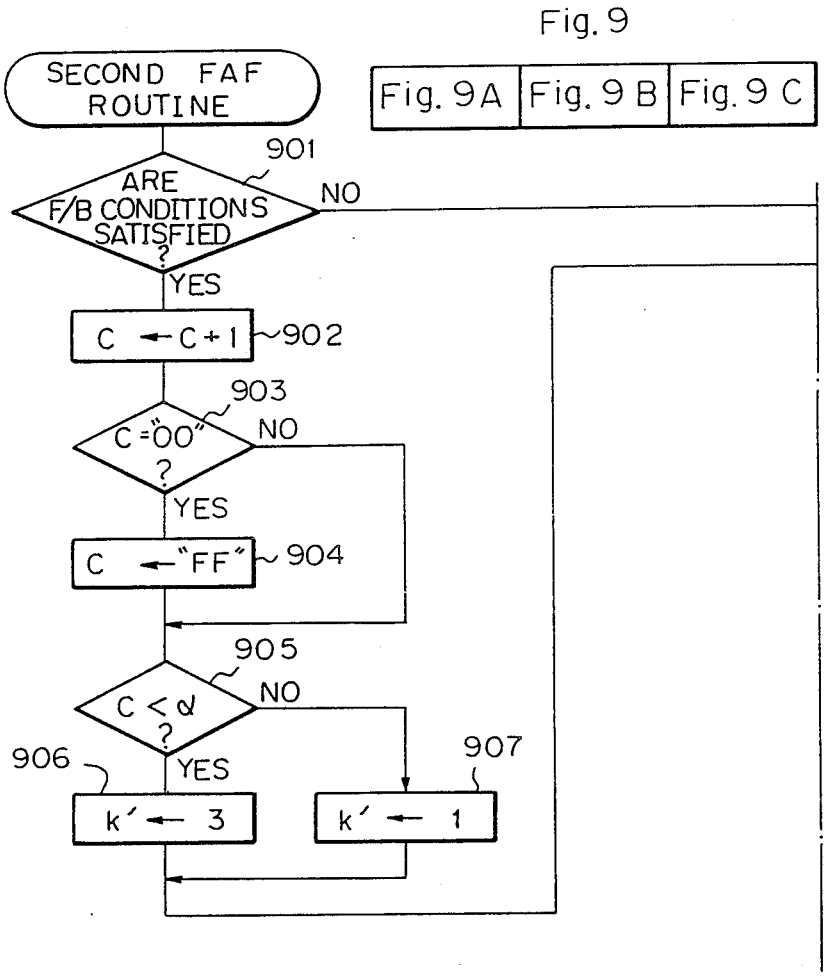
Figure 9B:
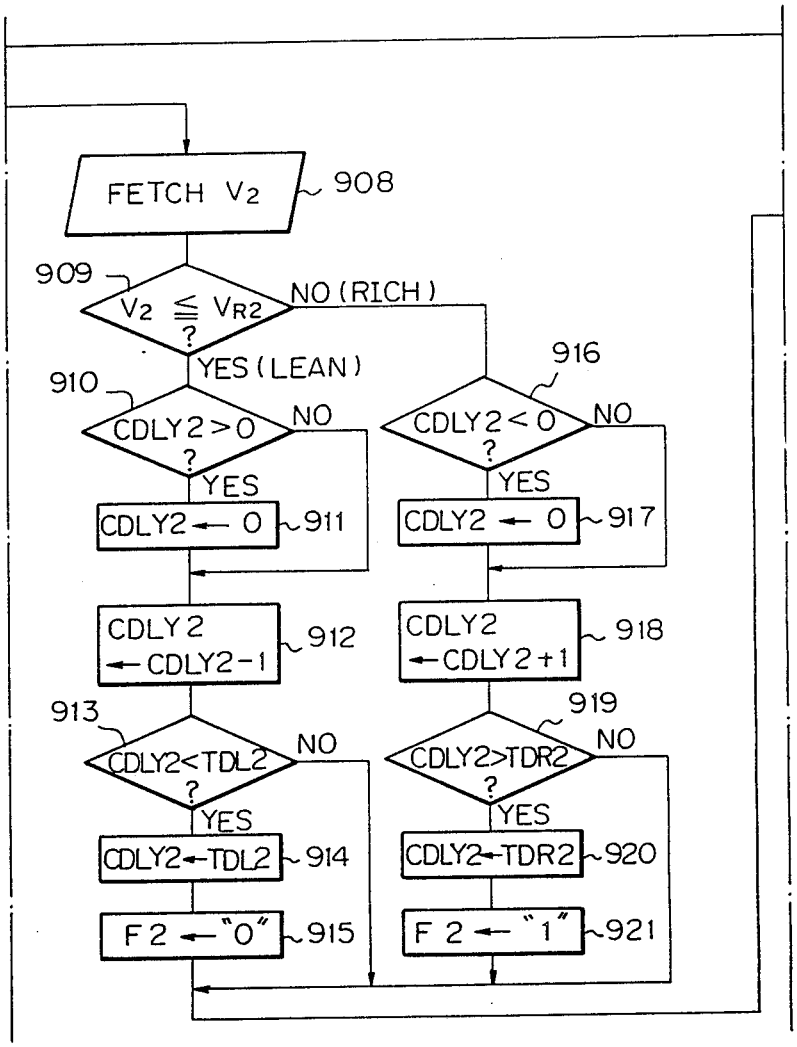
Figure 9C:
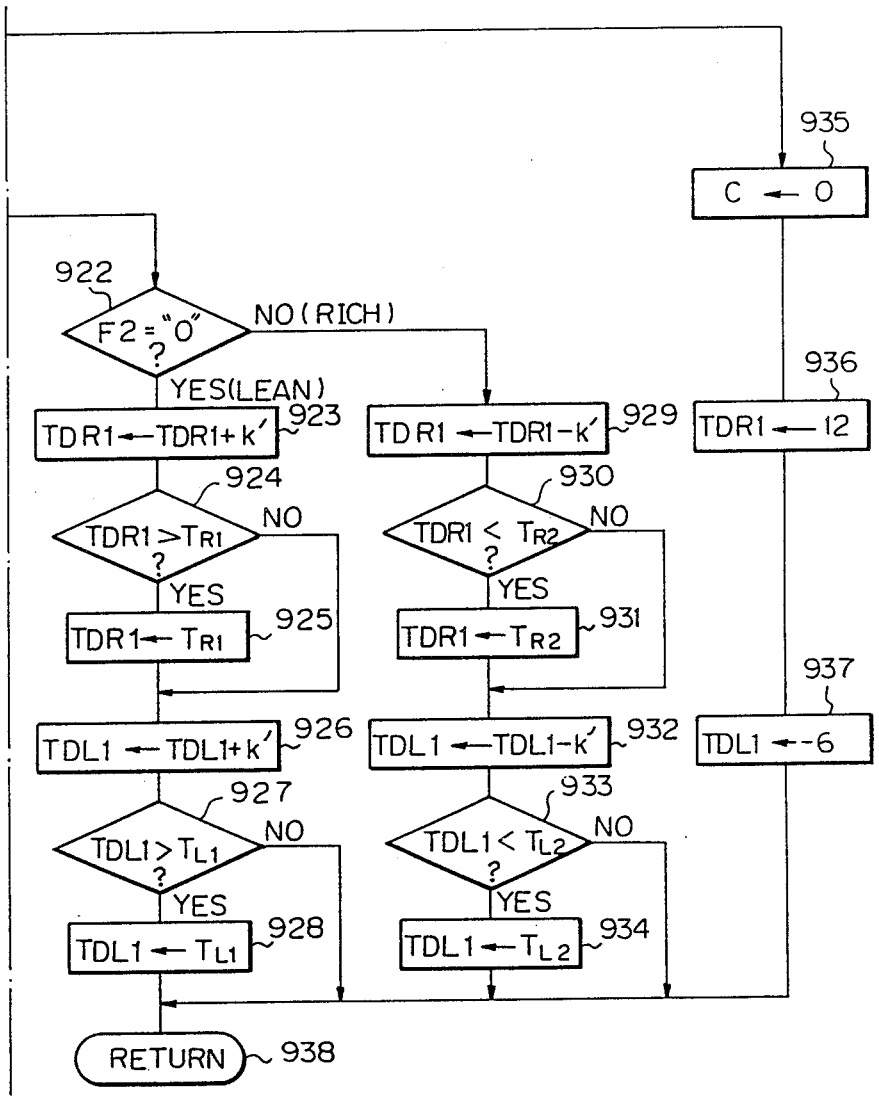

FIG. 9 is a routine for calculating the delay time periods TDR1 and TDL1 in accordance with the output of the downstream-side $O_2$ sensor 15 executed at every predetermined time period such as 1 s.

Steps 901 through 921 are the same as steps 501 through 521 of FIG. 5. That is, if one or more of the feedback control conditions is not satisfied, the control proceeds to step 935 which clears the counter C. Then, the control proceeds to step 936 in which the rich delay time period TDR1 is caused to be a definite value such as 12 corresponding to 48 ms, and also proceeds to step 937 in which the lean delay time period TDL1 is caused to be a definite value such as −6 corresponding to 24 ms, thereby carrying out an open-loop control for the downstream-side $O_2$ sensor 15. Note that the rich delay time period TDR1 is preferably larger than the lean delay time period (−TDL1), in consideration of the difference in output characteristics and deterioration speed between the $O_2$ sensor 13 upstream of the catalyst converter 12 and the $O_2$ sensor 15 downstream of the catalyst converter 12, so that the reference voltage $V_{R2}$ is higher than the reference voltage $V_{R1}$.

Contrary to the above, at step 901, if all of the feedback control conditions are satisfied, the control proceeds to step 902.

Steps 902 through 907 correspond to steps 502 through 507, respectively, of FIG. 5. That is, when the engine is switched from an open-loop control to a closed-loop control, the flow at step 901 proceeds to step 902, which advances the counter C. At steps 903 and 904, the counter C is guarded by a maximum value such as 'FF' (hexadecimal notation), and then, the control proceeds to step 905, which determines whether or not the counter C exceeds a predetermined value $\alpha$. If $C>\alpha$, the control proceeds to step 906, which causes a parameter k' to be 3, while, if $C\leqq\alpha$, the control proceeds to step 907, which causes the parameter k' to be 1. Note that the parameter k' determines the feedback control speed by the downstream-side $O_2$ sensor 15. In this case, the parameter k' serves as a correction coefficient for correcting the delay time periods TDR1 and TDL1. Therefore, the correction speed (time constant) of the delay time periods TDR1 and TDL1 where $C>\alpha$ is three times that where $C\leqq\alpha$. However, the parameter k' can be also a value other than 3 (k'1).

Steps 908 through 921 correspond to step 508 through 521, respectively, of FIG. 5. That is, at steps 910 through 921, a delay operation is performed upon the determination at step 909. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, the second air-fuel ratio flag F2 is caused to be "0".

At step 922, it is determined whether or not the second air-fuel ratio F2 is "0". If F2="0", which means that the air-fuel ratio is lean, the control proceeds to steps 923 through 928, and if F2="1", which means that the air-fuel ratio is rich, the control proceeds to steps 929 through 934.

At step 923, the rich delay time period TDR1 is increased by k' to move the air-fuel ratio to the rich side. At steps 924 and 925, the rich delay time period TDR1 is guarded by a maximum value $T_{R1}$. Note that the value $T_{R1}$ is positive, and accordingly, the value $-T_{R1}$ means a maximum rich delay time period. Further, at step 926, the lean delay time period TDL1 is increased by k' to move the air-fuel ratio to the rich side. At steps 927 and 928, the lean delay time period TDL1 is guarded by a maximum value $T_{L1}$. Note that the value $T_{L1}$ is negative, and accordingly, the value $T_{L1}$ means a minimum lean delay time period.

On the other hand, at step 929, the rich delay time period TDR1 is decreased by k' to move the air-fuel ratio to the lean side. At steps 930 and 931, the rich delay time period TDR1 is guarded by a minimum value $T_{R2}$. Note that the value $T_{R2}$ is also positive, and accordingly, the value $-T_{R2}$ means a minimum rich delay time period. Further, at step 932, the lean delay time period TDL1 is decreased by k' to move the air-fuel ratio to the lean side. At steps 933 and 934, the lean delay time period TDL1 is guarded by a minimum value $T_{L2}$. Note that the value $T_{L2}$ is also negative, and accordingly, the value $(-T_{L2})$ means a maximum lean delay time period.

The delay time period TDR1 and TDL1 are then stored in the RAM 105, thereby completing this routine of FIG. 9 at step 938.

Thus, for a predetermined time period ($C<\alpha$) after the engine enters an air-fuel feedback control for the downstream-side $O_2$ sensor 15, the correction speed of the delay time periods TDR1 and TDL1 is increased, and therefore, the controlled air-fuel ratio promptly reaches an optimum level even when the controlled air-fuel ratio is greatly deviated from this optimum level during an open-loop control.

Figure 10:
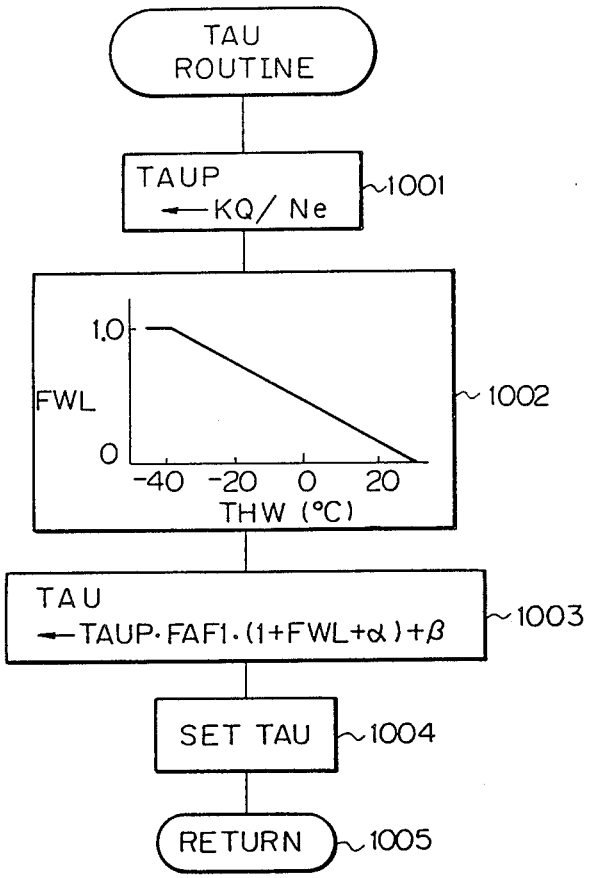

FIG. 10 is a routine for calculating a fuel injection amount TAU executed at every predetermined crank angle such as 360° CA. At step 1001, a base fuel injection amount TAUP is calculated by using the intake air amount data Q and the engine speed data Ne stored in the RAM 105. That is, $$TAUP \leftarrow KQ/Ne$$

where K is a constant. Then at step 1002, a warming-up incremental amount FWL is calculated from a one-dimensional map by using the coolant temperature data THW stored in the RAM 105. Note that the warming-up incremental amount FWL decreases when the coolant temperature THW increases. At step 1003, a final fuel injection amount TAU is calculated by $$TAU \leftarrow TAUP \cdot FAF1 \cdot (1+FWL+\alpha)+\beta$$

where $\alpha$ and $\beta$ are correction factors determined by other parameters such as the voltage of the battery and the temperature of the intake air. At step 1004, the final fuel injection amount TAU is set in the down counter 108, and in addition, the flip-flop 109 is set to initiate the activation of the fuel injection valve 7. Then, this routine is completed by step 1005. Note that, as explained above, when a time period corresponding to the amount TAU has passed, the flip-flop 109 is reset by the carry-out signal of the down counter 108 to stop the activation of the fuel injection valve 7.

Figures 11A, 11B, 11C, 11D, 11E, 11F, 11G, 11H:
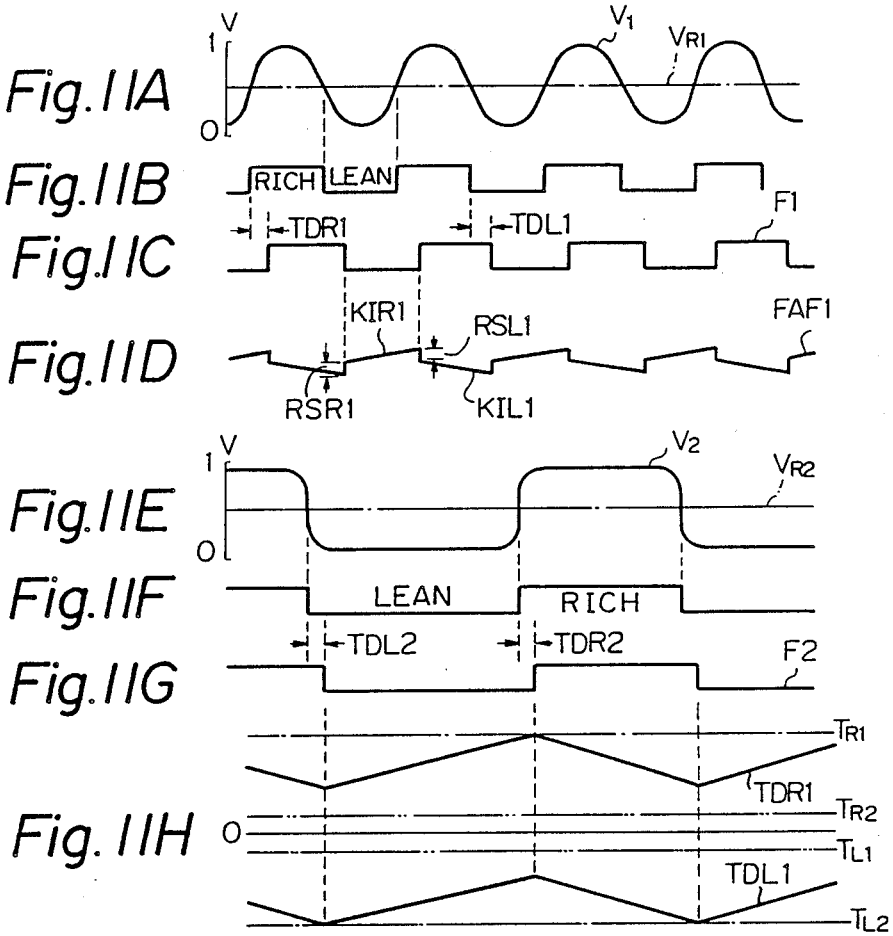
FIGS. 11A through 11H, and FIGS. 12A through 12E are timing diagrams explaining the flow charts of FIGS. 3, 9, and 10; and FIGS., 14A through 14D are timing diagrams for explaining the flow chart of FIG. 13.

FIGS. 11A through 11H are timing diagrams for explaining the air-fuel ratio correction amount FAF1 and the delay time periods TDR1 and TRL1 obtained by the flow charts of FIGS. 3, 9, and 10. FIGS. 11A through 11F are the same as FIGS. 7A through 7F, respectively. As shown in FIGS. 11G and 11H, when the delayed determination F2 is lean, both of the delay time periods TDR1 and TDL1 are increased, and when the delayed determination F2 is rich both of the delay time periods TDR1 and TDL1 are decreased. In this case, the rich delay time period TDR1 is changed within a range of from $T_{R1}$ to $T_{R2}$, and the lean delay time period TRL1 is changed within a range of from $T_{L1}$ to $T_{L2}$.

In a second air-fuel ratio control by the downstream-side $O_2$ sensor 15, a transition from an open-loop control to a closed-loop control will be explained in more detail with reference to FIGS. 12A through 12E. For example, before time $t_0$, the output of the downstream-side $O_2$ sensor 15 remains on the rich side as shown in FIG. 8A. In this case, the counter C remains at zero as shown in FIG. 12D, and the rich delay time period TDR1 is caused at 12 and the lean delay time period TDL1 is caused at $-6$ as shown in FIG. 12E. At time $t_0$, the engine enters a closed-loop control, and the counter C is advanced. As a result, for a time period of from time $t_0$ to time $t_1$ at which the counter C reaches $\alpha$, the rich delay time period TDR1 and the lean delay time period TDL1 are both decreased at the speed of 3/s (k'=3), and subsequently, the rich delay time period TDR1 and the lean delay time period TDL1 are both decreased at the speed of 1/s (k'=1). As a result, the rich delay time period TDR1 and the lean delay time period TDL1 promptly reach the respective desired levels, and accordingly, the controlled air-fuel ratio reaches the optimum level such as the stoichiometric air-fuel ratio. Note that FIG. 12B illustrates the determination at step 909 of FIG. 9 and FIG. 12C illustrates the second air-fuel ratio flag F2.

Figures 12A, 12B, 12C, 12D, 12E:
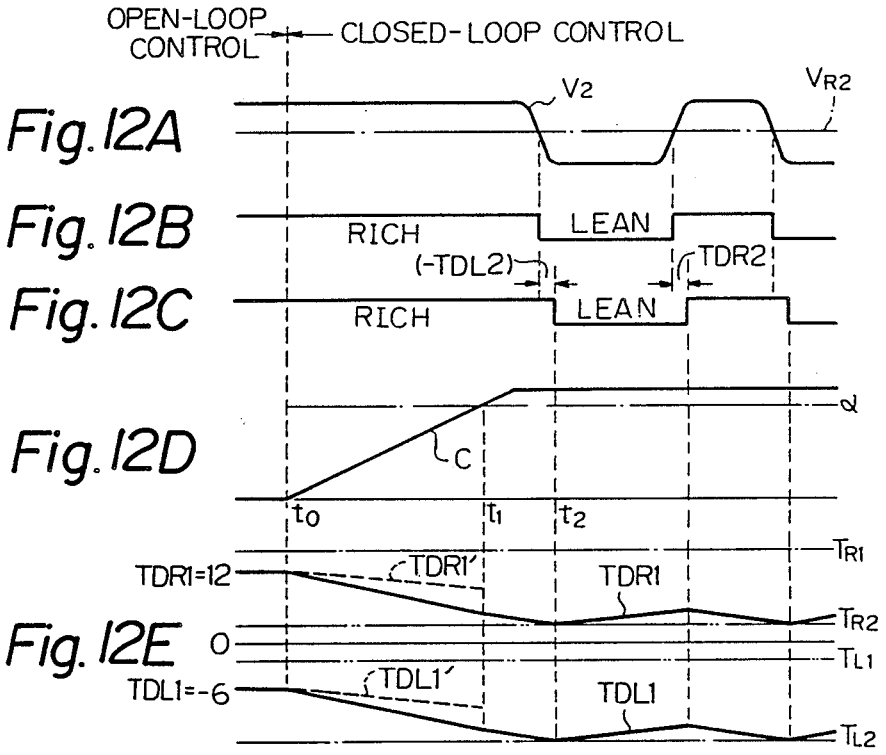

If the rich delay time period TDR1 and the lean delay time period TDL1 are decreased at the speed of 1/s even after the time $t_0$, these delay time periods are changed as indicated by dotted lines in FIG. 12E, and therefore, a long time period must elapse before these delay time periods reach the desired levels.

Figure 13:
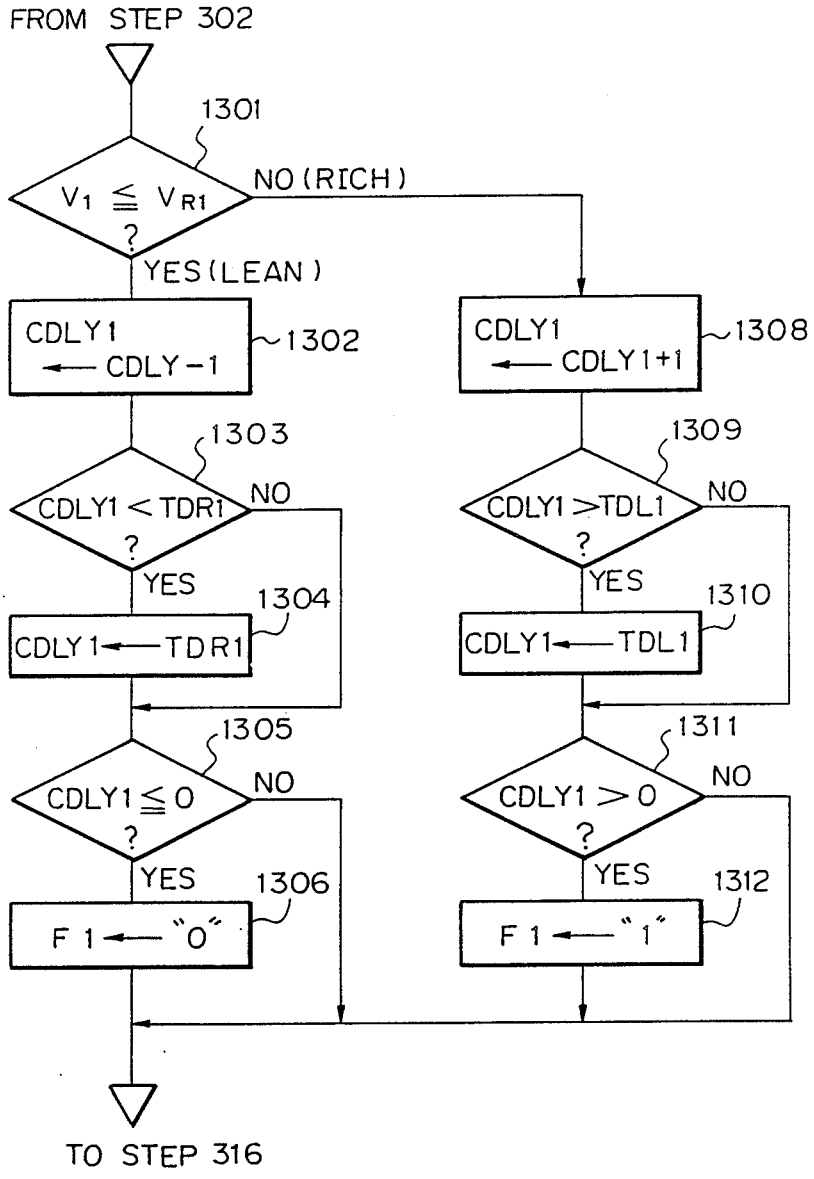

In FIG. 13, which is a modification of FIG. 3, a delay operation different from that of FIG. 3 is carried out. That is, at step 1301, if $V_1 \leqq V_{R1}$, which means that the current air-fuel ratio is lean, the control proceeds to step 1302 which decreases a first delay counter CDLY1 by 1. Then, at staps 1303 and 1304, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1>0, this means that the delayed air-fuel ratio is rich, while, if CDLY1≦0, this means that the delayed air-fuel ratio is lean.

Therefore, at step 1305, it is determined whether or not CDLY≦0 is satisfied. As a result, if CDLY1≦0, at step 2906, the first air-fuel ratio flag F1 is caused to be "0" (lean). Otherwise, the first air-fuel ratio flag F1 is unchanged, that is, the flag F1 remains at "1".

On the other hand, if $V_1 > V_{R1}$, which means that the current air-fuel ratio is rich, the control proceeds to step 1304 which increases the first delay counter CDLY1 by 1. Then, at steps 1309 and 1310, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at step 1311, it is determined whether or not CDLY>0 is satisfied. As a result, if CDLY>0, at step 1312, the first air-fuel ratio flag F1 is caused to be "1" (rich). Otherwise, the first air-fuel ratio flag F1 is unchanged, that is, the flag F1 remains at "0".

Figures 14A, 14B, 14C, 14D:
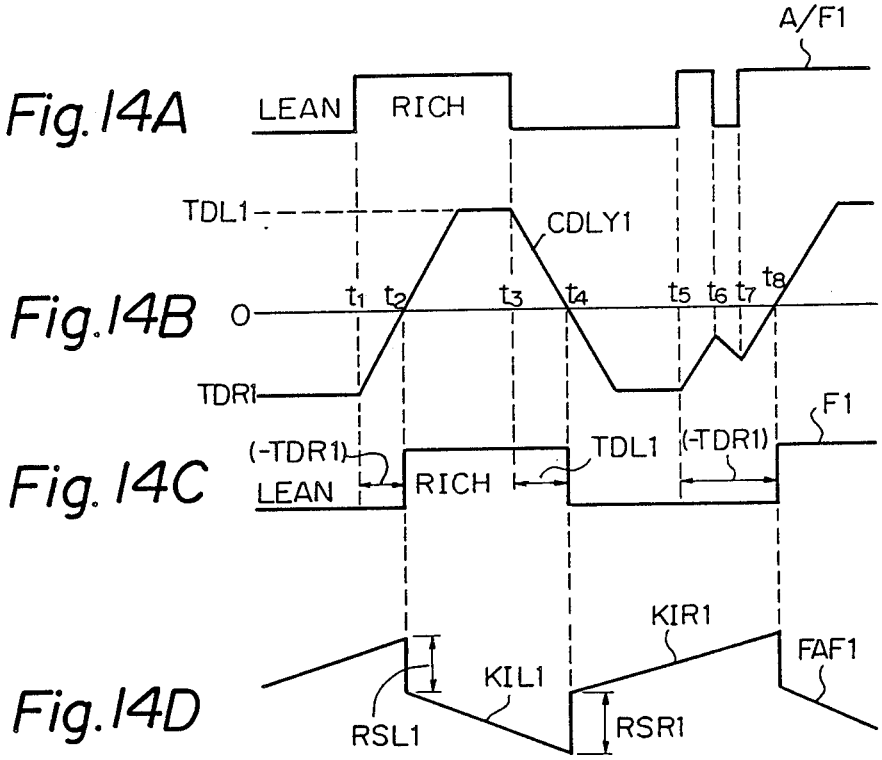

The operation by the flow chart of FIG. 13 will be further explained with reference to FIGS. 14A through 14D. As illustrated in FIG. 14A, when the air-fuel ratio A/F1 is obtained by the output of the upstream-side $O_2$ sensor 13, the first delay counter CDLY1 is counted up during a rich state, and is counted down during a lean state, as illustrated in FIG. 14B. As a result, the delayed air-fuel ratio A/F1' is obtained as illustrated in FIG. 14C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed from the rich side to the lean side, the delayed air-fuel ratio A/F1' is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1' is reversed at time $t_8$. That is, the delayed air-fuel ratio A/F1' is stable when compared with the air-fuel ratio A/F1. Further, as illustrated in FIG. 14D, at every change of the delayed air-fuel ratio A/F1' from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Note that, in this case, during an open-control mode, the rich delay time period TDR1 is, for example, −12 (48 ms), and the lean delay time period TDL1 is, for example, 6 (24 ms).

Figure 15:
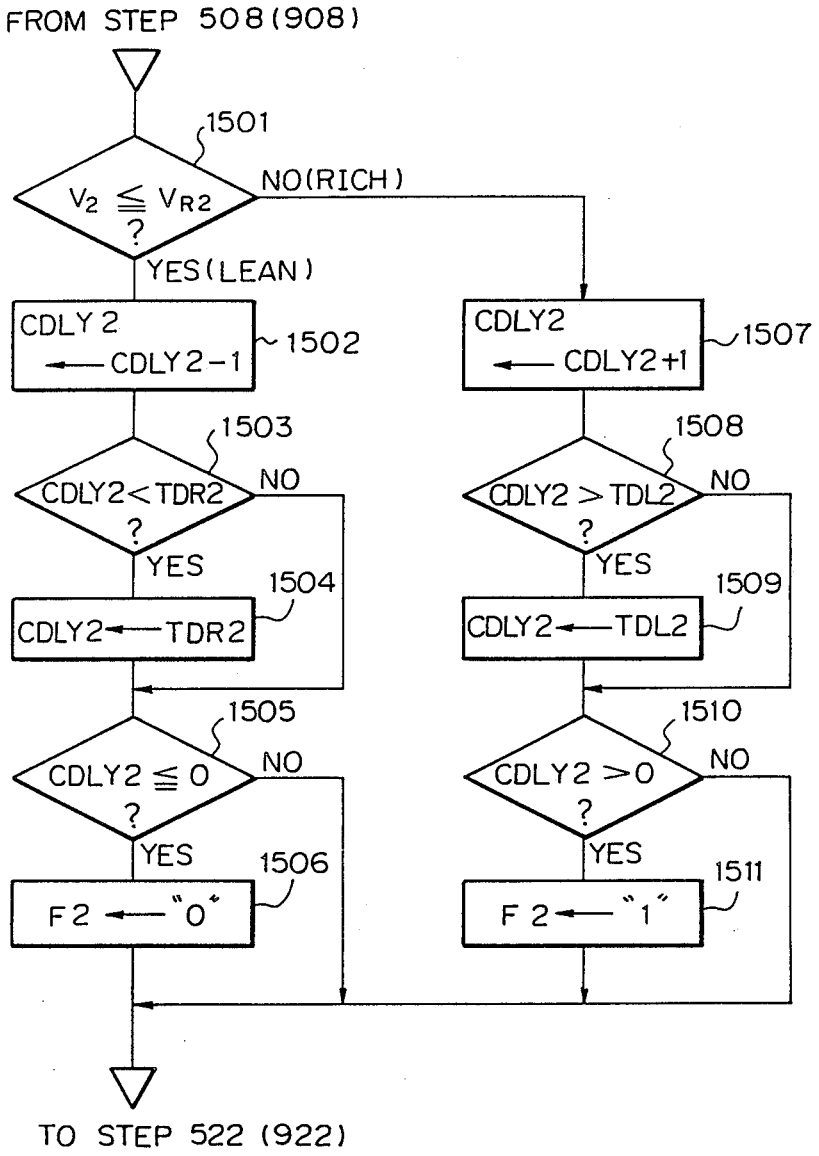

In FIG. 15, which is a modification of FIGS. 5 (or 9), the same delay operation as in FIG. 13 is carried out, and its detailed explanation is omitted. In this case, however, the delay time periods TDR1 and TDL1 are both decreased at steps 523 and 526 (923 and 926), and the delay time periods TDR1 and TDL1 are both increased at steps 529 and 532 (929 and 932).

Note that the calculated parameters FAF1 and FAF2, or FAF1, TDR1, and TDL1 can be stored in the backup RAM 106, thereby improving drivability at the re-starting of the engine.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the skip amounts RSR1 and RSL1, the integration amounts KIR1 and KIL1, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 601 of FIG. 6 or at step 1001 of FIG. 10 is determined by the carburetor itself, i.e., the intake air negative pressure and the engine speed, and the air amount corresponding to TAU at step 603 of FIG. 6 or at step 1003 of FIG. 10.

Further, a CO sensor, a lean-mixture sensor or the like can be also used instead of the $O_2$ sensor.

As explained above, according to the present invention, when the engine enters a closed-loop control (air-fuel ratio feedback control) for the downstream-side air-fuel ratio sensor ($O_2$ sensor), the controlled air-fuel ratio can promptly reach an optimum air-fuel ratio such as the stoichiometric air-fuel ratio, thereby improving the fuel comsumption, the drivability, and the emissions.

We claim:

1. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising the steps of:

determining whether or not said engine satisfies first predetermined air-fuel ratio feedback control conditions;

compariing the output of said upstream-side air-fuel ratio sensor with a first predetermined reference voltage when said engine satisfies said first predetermined air-fuel ratio feedback control conditions;

changing a first air-fuel ratio correction amount in accordance with a result of the comparison of the output of said upstream-side air-fuel ratio sensor with said first predetermined reference voltage;

determining whether or not said engine satisfies second predetermined air-fuel ratio feedback control conditions;

comparing the output of said downstream-side air-fuel ratio sensor with a second predetermined reference voltage when said engine satisfies said second predetermined air-fuel ratio feedback control conditions;

changing a second air-fuel ratio correction amount in accordance with a result of the output of said downstream-side air-fuel ratio sensor with said second predetermined reference voltage, the changing speed of said second air-fuel ratio correction amount being larger for a predetermined time period after said engine satisfies said second predetermined air-fuel ratio feedback control conditions than after said predetermined time period has passed; and adjusting the actual air-fuel ratio in accordance with said first and second air-fuel ratio correction amounts.

2. A method as set forth in claim 1, wherein said second air-fuel ratio correction amount changing step comprises the steps of:

calculating an air-fuel ratio feedback control parameter in accordance with a result of the output of said downstream-side air-fuel ratio sensor with said second predetermined reference voltage, so that said air-fuel feedback control parameter is larger for said predetermined time period after said engine satisfies said second predetermined air-fuel ratio control conditions; and calculating said second air-fuel ratio correction amount in accordance with said air-fuel ratio feedback control parameter and a result of the output of said downstream-side air-fuel ratio sensor with said second predetermined reference voltage.

3. A method as set forth in claim 2, wherein said air-fuel ratio feedback control parameter is determined by a rich integration amount by which said second air-fuel ratio feedback correction amount is gradually increased when the comparison result of said downstream-side air-fuel ratio sensor is on the lean side, and a lean integration amount by which said second air-fuel ratio correction amount is gradually decreased when the comparison result of said downstream-side air-fuel ratio sensor is on the rich side.

4. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising the steps of:

determining whether or not said engine satisfies first predetermined air-fuel ratio feedback control conditions;

comparing the output of said upstream-side air-fuel ratio sensor witha first predetermined reference voltage when said engine statisfies said first predetermined air-fuel ratio feedback control conditions;

determining whether or not said engine satisfies second predetermined air-fuel ratio feedback control conditions;

comparing the output of said downstream side air-fuel ratio sensor with a second predetermined reference voltage when said engine satisfies said second predetermined air-fuel ratio feedback control conditions;

changing an air-fuel ratio feedback control parametr in accordance with a result of the output of said downstream-side air-fuel ratio sensor with said second predetermined reference voltage, the changing speed of said air-fuel ratio feedback control parameter being larger for a predetermined time period after said engine satisfies said second predetermined air-fuel ratio feedback control conditions than after said predetermined time period has passed; and changing an air-fuel ratio correction amount in accordance with said air-fuel ratio feedback control parameter and a result of the comparison of the output of said upstream-side air-fuel ratio sensor with said first predetermined reference voltage; and adjusting the actual air-fuel ratio in accordance with said air-fuel ratio correction amount.

5. A method as set forth in claim 4, wherein said air-fuel ratio feedback control parameter is determined by a rich delay time period for delaying the result of the comparison of said upstream-side air-fuel ratio sensor switched from the lean side to the rich side and a lean delay time period for delaying the result of the comparison of said upstream-side air-fuel ratio sensor switched from the rich side to the lean side.

6. A method as set forth in claim 4, wherein said air-fuel ratio feedback control parameter is determined by a rich skip amount by which said air-fuel ratio feedback correction amount is skipped up at a switching of the comparison result of said upstream-side air-fuel ratio sensor from the rich side to the lean side, and a lean skip amount by which said air-fuel ratio feedback correction amount is skipped down at a switching of the comparison result of said upstream-side air-fuel ratio sensor from the lean side to the rich side.

7. A method as set forth in claim 4, wherein said air-fuel ratio feedback control parameter is determined by a rich integration amount by which said air-fuel ratio feedback correction amount is gradually increased when the comparison result of said upstream-side air-fuel ratio sensor is on the lead side, and a lean integration amount by which said air-fuel ratio feedback correction amount is gradually decreased when the comparison result of said upstream-side air-fuel ratio sensor is on the rich side.

8. A method as set forth in claim 4, wherein said air-fuel ratio feedback control parameter is determined by said first predetermined reference voltage.

9. An apparatus for controlling the air-fuel ratio in an internal combustion engine haging a catalyst converter for removing pollutants in the exhaust gas thereof, and upstream-side and donwstream-side air-fuel ratio sensors disposed upstream and downstream, respectively, of said catalyst converter for detecting a concentration of a specific component in an exhaust gas, comprising:

means for determining whether or not said engine satisfies first predetermined air-fuel ratio feedback control conditions;

means for comparing the output of said upstream-side air-fuel ratio sensor with a first predetermined reference voltage when said engine satisfies said first predetermined air-fuel ratio feedback control conditions;

means for changing a first air-fuel ratio correction amount in accordance with a result of the comparison of the output of said upstream-side air-fuel ratio sensor with said first predetermined reference voltage;

means for determining whether or not said engine satisfies second predetermined air-fuel ratio feedback control conditions;

means for comparing the output of said downstream-side air-fuel ratio sensor with a second predetermined reference voltage when said engine satisfies said second predetermined air-fuel ratio feedback control conditions;

means for changing a second air-fuel ratio correction amount in accordance with a result of the output of said downstream-side air-fuel ratio sensor with said second predetermined reference voltage, the changing speed of said second air-fuel ratio correction amount being larger for a predetermined time period after said engine satisfies said second predetermined air-fuel ratio feedback control conditions than after said predetermined time period has passed; and means for adjusting the actual air-fuel ratio in accordance with said first and second air-fuel ratio correction amounts.

10. An apparatus as set forth in claim 9, wherein said second air-fuel ratio correction amount changing means comprises:

means for calculating an air-fuel ratio feedback control parameter in accordance with a result of the output of said downstream-side air-fuel ratio sensor with said second predetermined referenced voltage, so that said air-fuel feedback control parameter is larger for said predetermined time period after said engine satisfies said second predetermined air-fuel ratio control conditions; and means for calculating said second air-fuel ratio correction amount in accordance wiht said air-fuel ratio feedback control parameter and a result of the output of said downstream-side air-fuel ratio sensor with said second predetermined reference voltage.

11. An apparatus as set forth in claim 10, wherein said air-fuel ratio feedback control parameter is determined by a rich integration amount by which said second air-fuel ratio feedback correction amount is gradually increased when the comparison result of said downstream-side air-fuel ratio sensor is on the lean side, and a lean integration amount by which said second air-fuel ratio feedback correction amount is gradually decreased when the comparison result of said downstream-side air-fuel ratio sensor is on the rich side.

12. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising:

means for determining whether or not said engine satisfies first predetermined air-fuel ratio feedback control conditions;

means for comparing the output of said upstream-side air-fuel ratio sensor with a first predetermined reference voltage when said engine satisfies said first predetermined air-fuel ratio feedback control conditions;

means for determining whether or not said engine satisfies second predtermined air-fuel ratio feedback control conditions;

means for comparing the output of said downstream-side air-fuel ratio sensor with a second predetermined reference voltage when said engine satisfies said second predetermined air-fuel ratio feedback control conditions;

means for changing an air-fuel ratio feedback control parameter in accordance with a result of the output of said downstream-side air-fuel ratio sensor with a said second predetermined reference voltage, the changing speed of said air-fuel ratio feedback control parameter being larger for a predetermined time period after said engine satisfies said second predermined air-fuel ratio feedback control conditions than after said predetermined time period has passed; and means for changing an air-fuel ratio correction amount in accordance with said air-fuel ratio feedback control parameter and a result of the output of said upstream-side air-fuel ratio sensor with said first predetermined reference voltage; and means for adjusting the actual air-fuel ratio in accordance with said air fuel ratio correction amount.

13. An apparatus as set forth in claim 12, wherein said air-fuel ratio feedback control parameter is determined by a rich delay time period for delaying the result of the comparison of said upstream-side air-fuel ratio sensor switched from the lean side to the rich side and a lean delay time period for delaying the result of the comparison of said upstream-side air-fuel ratio sensor switched from the rich side to the lean side.

14. An apparatus as set forth in claim 12, wherein said air-fuel ratio feedback control parameter is determined by a rich skip amount by which said air-fuel ratio feedback correction amount is skipped up at a switching of the comparison result of said upstream-side air-fuel ratio sensor from the rich side to the lean side, and a lean skip amount by which said air-fuel ratio feedback correction amount is skipped down at a switching of the comparison result of said upstream-side air-fuel ratio sensor from the lean side to the rich side.

15. An apparatus as set forth in claim 12, wherein said air-fuel ratio feedback control parameter is determined by a rich integration amount by which said air-fuel ratio feedback correction amount is gradually increased when the comparison result of said upstream-side air-fuel ratio sensor is on the lean side, and a lean integration amount by which said air-fuel ratio feedback correction amount is gradually decreased when the comparison result of said upstream-side air-fuel ratio sensor is on the rich side.

16. An apparatus as set forth in claim 12, wherein said air-fuel ratio feedback control parameter is determined by said first predetermined reference voltage.

* * * * *